United States Patent [19]

Kropp

[11] Patent Number: 4,617,854

[45] Date of Patent: Oct. 21, 1986

[54] MULTIPLE CONSUMER HYDRAULIC MECHANISMS

[75] Inventor: Walter Kropp, Aschaffenburg, Fed. Rep. of Germany

[73] Assignee: Linde Aktiengesellschaft, Wiesbaden, Fed. Rep. of Germany

[21] Appl. No.: 617,113

[22] Filed: Jun. 4, 1984

[30] Foreign Application Priority Data

Jun. 14, 1983 [DE] Fed. Rep. of Germany ..... 3321483

[51] Int. Cl.[4] ..... F15B 13/06; F15B 11/20

[52] U.S. Cl. ..... 91/517; 91/531; 60/422

[58] Field of Search ..... 60/420, 422; 91/420, 91/444, 446, 448, 517, 518, 526, 528, 531

[56] References Cited

U.S. PATENT DOCUMENTS 3,863,448 2/1975 Purdy ..... 60/422
4,020,867 5/1977 Sumiyoshi ..... 91/420 X

FOREIGN PATENT DOCUMENTS 2656032 12/1976 Fed. Rep. of Germany ... 91/446 X
3146513 6/1982 Fed. Rep. of Germany .
3044144 9/1982 Fed. Rep. of Germany .
0881380 11/1981 U.S.S.R. ..... 91/420

*Primary Examiner*—Robert E. Garrett
*Assistant Examiner*—M. Williamson
*Attorney, Agent, or Firm*—Buell, Ziesenheim, Beck & Alstadt

[57] ABSTRACT

A multiple consumer hydraulic device is provided having a pump and at least two consumers, where a multiway control valve throttling in the intermediate positions is located in front of each of these consumers and a hydraulically controlled additional valve is located in the line between the pump and this mulitway control valve and is acted upon in the closing direction by the pressure in front of this multiway control valve and is loaded in the opposite direction by the pressure of the assigned consumer in which case, in order to achieve a load-independent proportioning of the pump stream for both pumps with and pumps without load-sensing, the additional multiway valve is provided with two additional control pressure chambers, of which the one acting in the closing direction is acted upon by the pressure of the one of the consumers carrying the highest pressure, and the oppositely acting additional control pressure chamber is acted upon by the pressure in the delivery line of the pump.

3 Claims, 2 Drawing Figures

MULTIPLE CONSUMER HYDRAULIC MECHANISMS

This invention relates to multiple consumer hydraulic mechanisms and more particularly to hydraulic or hydrostatic devices with a pump and with at least two consumers of hydraulic energy acted upon by it, where a preferably arbitrarily actuatable or otherwise controlled multiway control valve that throttles in the intermediate positions is located in front of a consumer, i.e., in the inlet line leading to it and possibly the drain line leading away from it, and an additional hydraulically controlled (two-position/two connection) valve is located in the line between the pump and this multiway control valve, whose control pressure chamber loading in the closing direction is loaded by the pressure in front of the multiway control valve and whose control pressure chamber loading in the opening direction is loaded by the pressure between the multiway control valve and the consumer inlet. That is, the additional valve acts as a piston manometer. The familiar additional valves are additionally loaded in the closing direction with a spring, by which the regulating pressure difference is prescribed at the piston manometer. In these familiar devices the multiway valves with built-in quantity regulators apportion the pump stream load-independently in relation to the throttle openings at the multiway valve piston so long as the stream delivered by the pump matches the sum of the streams absorbed by the consumers. However, if the sum of the streams that a consumer absorbs exceeds the maximum delivery stream of the pump, the regulating pressure gradient prescribed by the spring will no longer be attained at the additional valve, with the result that the delivery stream of the pump flows to the consumer in which the lowest pressure acts, i.e., the one that is the relatively least loaded.

The invention proposes to improve a device of the said type so that even if the sum of the streams required by the individual consumers is greater than the maximum delivery stream of the pump, this delivery stream of the pump is apportioned to the individual consumers in the ratio in which the control valves assigned to a consumer are opened, i.e., so that the desired ratios of travel speeds are retained, so that, for example, if a resultant motion is controlled through the simultaneous loading of two consumers by the overlapping of their motions, this resultant motion retains the direction imposed and is reduced only in its absolute value in accordance with the small delivery stream of the pump.

This goal is achieved by the features specified in the characterization of claim 1.

In familiary hydraulic devices with load-sensing required-stream regulation, a drain opening, e.g., in the form of a flow-regulating valve, is provided at the load-sensing control pressure line, through which a small predetermined stream continuously flows off, in order to facilitate a relieving of the load-sensing control pressure line (DE-OS No. 31 46 513). Even this, however slight shortcoming of the familiar device can be avoided with the device according to the invention. When there are more than two consumers, an additional reversing valve must be connected in cascade connection for each consumer in excess of two.

The size of the active surface of the control pressure chambers also present in the devices known to date at the additional valve can be in a ratio of 1:1 to the size of the active surfaces of the additional control pressure chambers present according to the invention. However, a different size ratio can also be selected if the additional control pressure chambers are larger or smaller than the control pressure chambers corresponding to the state of the art known to date, in order to achieve certain effects.

Through the present invention, the great advantages of the load-sensing required-stream regulations with parallel-connected throttles, which effect a proportioning of the consumer streams in accordance with the desired impositions (see DE-OS No. 31 46 513 and DE-OS No. 30 44 144) are also carried over to hydraulic devices in which an arbitrarily actuatable multiway control valve that throttles in the intermediate positions located in front of each consumer and in which an additional hydraulically controlled valve is located in the line between the valve and the pump, the control pressure chamber of this additional valve, which loads in the closing direction, being acted upon by pressure in front of the multiway valve and its control chamber, which loads in the opening direction and is acted upon by the pressure of the assigned consumer. Just as the system with parallel-connected throttles according to the said DE-OS publications, the system according to the invention can be used not only in hydraulic arrangements, in which the pump is adjustable relative to the delivery volume per revolution and the adjustment setting is determined by the difference between the control pressure in the load-sensing control pressure line and the pressure in the delivery line, but also in devices with pumps whose delivery volume setting is dependent on or is arbitrarily controlled by another value or in devices with a constant pump, in which a possibly excessive stream is drained off through an auxillary drain valve.

In the foregoing general description of this invention I have set out certain objects, purposes and advantages of this invention. Other objects, purposes and advantages of the invention will be apparent from a consideration of the following description and the accompanying drawings in which.

Figure 1:
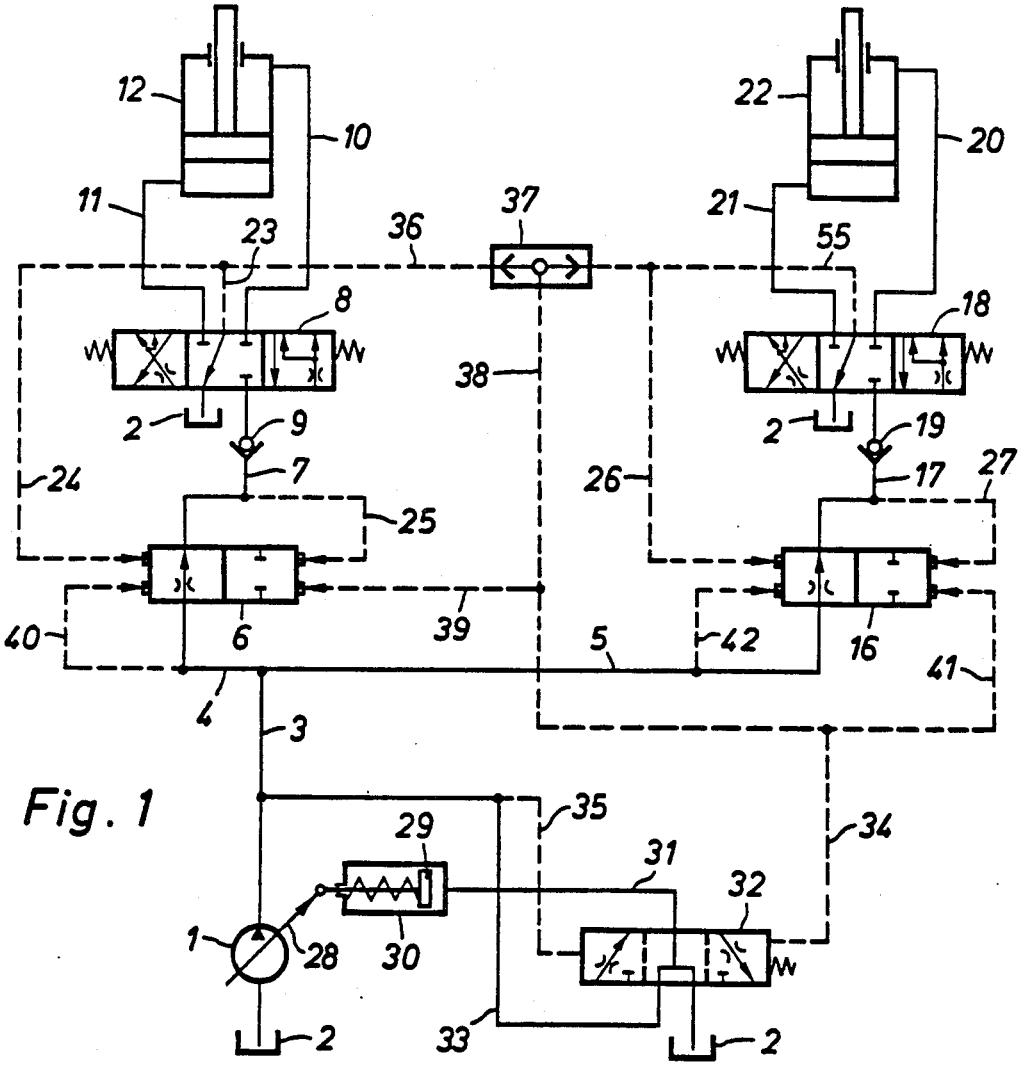
FIG. 1 shows a circuit diagram for a hydrostatic device according to the invention.

Referring to the drawings, the adjustable pump draws from a reservoir 2 and delivers into a delivery line 3, which forks into two branch feed lines 4 and 5. The feed line 4 leads to one connection of a two-position/two-connection multiway valve 6, to the second connection of which a line 7 is connected and leads to an inlet of an arbitrarily controllable multiway control valve 8, through which the line 7, into which a check valve 9 is incorporated, can be selectively connected either with line 10 or with line 11, in which case the two lines 10 and 11 lead to the two pressure chambers of a cylinder 12. The one of the two lines 10 and 11 that is not connected with the line 7 through the multiway control valve 8 is connected with the reservoir 2.

In the same manner, the branch feed line 5 leads to an additional multiway valve 16, from which a line 17 departs; a check valve 19 is incorporated into this line 17, which leads to a multiway control valve 18. Two connections of the multiway control valve 18 are connected with the lines 20 and 21, which lead to the cylinder 22.

The multiway control valve 8 has a fifth connection, to which a control pressure line 23 is connected and continues into a control pressure line 24, which leads to a control pressure chamber of the additional multiway valve 6. A second control pressure chamber of the additional multiway valve 6 is connected to the control pressure line 25 which in turn is connected to the line 7.

In the same way as the control pressure line 23 is connected to the multiway control valve 8, a control pressure line 55 is connected to the multiway control valve 18 and acts on a control pressure chamber of the additional multiway valve 16 through a control pressure branch line 26, while the second control pressure chamber of the multiway valve 16 is acted upon through a control pressure line 27, which is connected to line 17.

The final control element 28 of the pump 1 is connected with a servo piston 29, which is capable of sliding in an operating cylinder 30 against the force of a spring, in which case the pressure chamber in the operating cylinder 30 is connected to a line 31, which is in turn connected to the pump adjustment control multiway valve 32, whose one inlet is connected to the line 33 that is connected on the other hand to the line 3, and whose third connection is connected with the reservoir 2. The valve 32 is hydraulically controlled, whereby the spring-side control pressure chamber is connected to the control pressure line 34 and the opposite control pressure chamber is connected to the control pressure line 35, which is in turn connected to the line 33.

The pressure of the controlled consumer 12 or 22 prevails at the fifth connection of the multiway control valve 8 or 18.

Up to this point, the device corresponds to the familiar state of the art.

A control pressure line 36 is also connected to the control pressure line 23 and it is connected to one inlet of a reversing valve 37, to whose second inlet the control pressure line 55 is connected and to whose outlet the control pressure line 38 is connected. The pressure that prevails in the one of the two lines 23 or 55 that carries the higher pressure thus always prevails in the control pressure line 38. A branch control pressure line 39 is connected to the line 38 and it leads to an additional control pressure chamber of the additional multiway valve 6, to the one loading in the closing position. The opposite additional control pressure chamber of the additional multiway valve 6 is connected to a control pressure line 40, which in turn is connected to the branch feed line 4. The control pressure line 38 continues on into a control pressure line 41, which leads to an additional control pressure chamber of the additional multiway valve 16, in which case an opposite additional control pressure chamber of this additional multiway valve 16 is connected to the control pressure line 42, which in turn is connected to the branch feed line 5.

The mode of operation is as follows: through arbitrary control of the multiway control valve 8 a connection is established with an arbitrarily selectable throttling action between the line 7 and the line 10 or optionally between the line 7 and line 11. Because the other of the two lines 10 and 11 is connected with the reservoir 2, a stream whose magnitude is determined by the throttling action selected flows. The multiway control valve 18 can be controlled in the same manner, in which case both multiway control valves 8 and 18 can be simultaneously regulated.

In the devices known to date, a spring loading in the closing direction is provided at the additional multiway valve 6 or 16, whereby a regulating pressure differential was invariably prescribed at this additional multiway valve through the characteristics of this spring. In contrast, the additional valves according to the invention are additionally influenced by the pressure differential in the additional control pressure chambers, whereby this additional influence occurs at the site of the action of the spring. This pressure differential in the additional control pressure chambers can be variable in order to be able to effect an adaptation to the prevailing situation.

Figure 2:
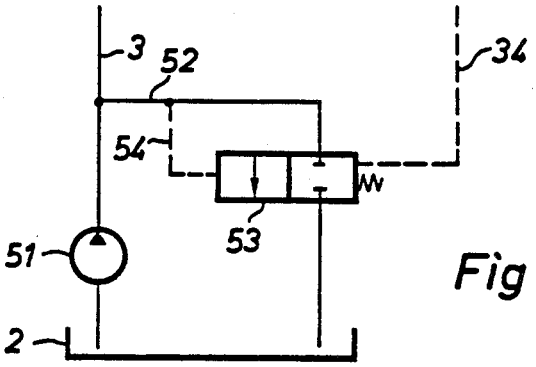
FIG. 2 shows the pump-side section of the circuit diagram in an embodiment with a constant pump and auxiliary drain valve.

FIG. 2 depicts another embodiment of the pump zone alone, up to the delivery line 3, i.e., with a constant pump 51, whereby a secondary drain line 52 is connected to the delivery line 3 and it leads to an auxiliary drain valve 53, which produces the connection to the reservoir 2 and which is controlled by the pressure differential between the lines 52, whose pressure is transferred over the control line 54 to a pressure chamber of the auxiliary drain valve 53, and the control pressure line 34 so that when the delivery stream of the pump 1 is greater than the streams absorbed by the sum of the consumers 12 and 22, the auxiliary drain valve is opened and drains off the excess stream.

In the foregoing specification I have set out certain preferred practices and embodiments of this invention, however, it will be understood that this invention may be otherwise embodied within the scope of the following claims.

I claim:

1. In a hydraulic device with a pump and with at least two hydraulic-energy consumers acted upon by the pump, where an arbitrarily actuatable multiway control valve that throttles in the intermediate positions is located in front of each consumer and an additional hydraulically controlled valve is located in the line between the pump and this multiway control valve, the control pressure chamber of this additional valve, which loads in the closing direction, being acted upon by the pressure in front of the multiway control valve and its control pressure chamber, which loads in the opening direction, being acted upon by the pressure of the assigned consumer, the improvement comprising said additional multiway valve having two additional control pressure chambers, of which the additional control pressure chamber loading in the closing direction is acted upon by the pressure of the consumer loaded with the highest pressure and the additional control pressure chamber loading in the opening direction is loaded with the pressure in the delivery line of the pump.

2. Device according to claim 1, wherein the control pressure line carrying the pressure of a consumer and pertaining to said at least two consumers are connected to a reversing valve, whose outlet is connected with the additional control pressure chamber of the additional multiway valve, which loads in the closing direction.

3. Device according to claim 1, characterized in that the active surfacesof the control pressure chambers of an or each additional multiway valve are the same size as the active surface of the additional control pressure chambers of the same said additional multiway valve.

* * * * *